United States Patent [19]

Maidment et al.

[11] Patent Number: 4,843,679

[45] Date of Patent: Jul. 4, 1989

[54] X-HINGE HAVING THE BENDABLE STRIP ENDS CRIMPED BETWEEN TWO PLATES

[75] Inventors: Robert A. M. Maidment, Suffolk; Michael T. Smith, Kent, both of United Kingdom

[73] Assignee: Frictionless Hinges & Joints Limited, United Kingdom

[21] Appl. No.: 175,940

[22] Filed: Mar. 31, 1988

[30] Foreign Application Priority Data

Apr. 3, 1987 [GB] United Kingdom ..... 8708012

[51] Int. Cl.[4] ..... E05D 1/06

[52] U.S. Cl. ..... 16/227; 16/252; 16/382; 16/DIG. 40; 29/11; 160/231.1; 403/51

[58] Field of Search ..... 16/225, 226, 227, 252, 16/362, 363, 382, DIG. 13, DIG. 40, DIG. 42, 135; 160/229.1, 231.1, 231.2, 233, 234; 29/11, 436, 446, 452; 403/50, 51; 277/101, 189, 213

[56] References Cited

U.S. PATENT DOCUMENTS 2,299,778 10/1942 Wissler ..... 29/446
2,611,659 9/1952 Hadley ..... 16/227 X
3,501,800 2/1970 O'Dea ..... 16/227
3,695,330 10/1972 Hasbrouck ..... 160/231.2 X
4,619,304 10/1986 Smith ..... 16/226 X
4,718,144 1/1988 Buckley ..... 16/341

FOREIGN PATENT DOCUMENTS 233657 9/1910 Fed. Rep. of Germany ..... 160/135

*Primary Examiner*—Fred A. Silverberg
*Attorney, Agent, or Firm*—Kane, Dalsimer, Sullivan, Kurucz, Levy, Eisele and Richard

[57] ABSTRACT

In a hinged structure in which two substantially cylindrical supports (1,2) are hinged together by means of one or more hinges so that they are parallel and closely adjacent, the or each hinge comprises at least two members (3,4) each made of resiliently flexible strip material, each member being S-shaped, passing partially around each support and together with one of the other members forming a letter "x" or figure "8" configuration as seen in a direction along the supports, the ends of the strips being crimped between plates (6,7,8,9) having opposed complementarily profiled surfaces, which plates are attached to the supports or extensions (14,15) of them whereby the strips are tensioned round the supports.

5 Claims, 2 Drawing Sheets

X-HINGE HAVING THE BENDABLE STRIP ENDS CRIMPED BETWEEN TWO PLATES

This invention relates to hinged structures.

We have previously described in U.S. Pat. specification No. 4,619,304, a hinged structure for use for example in producing display panels, in which two substantially cylindrical supports are hinged together so that they are parallel and closely adjacent by means of one or more hinges, wherein the or each hinge comprises at least two members each made of resiliently flexible strip material, for example sprung or tempered steel, each member being S-shaped, passing partially round each support and together with one of the other members forming a letter "X" or figure "8" configuration as seen in a direction along the supports, the ends of the strip members being fastened alongside each support so that the members are tensioned round the supports. A number of embodiments of that idea are described in U.S. Pat. specification No: 4,718,144, as are display systems incorporating such hinged structures.

It is important, in order for the hinged supports to be movable relative to each other in a frictionless manner, that the flexible strips should be under tension. In our earlier disclosures we have shown the use of plates, to which the ends of the strips are attached, for example by welding, which plates are attached to each other and to the supports.

We have been investigating the manner in which the strips are tensioned round the supports, and have discovered that good results can be achieved if, according to one aspect of this invention, the ends of the strips are crimped between plates having opposed complementarily profiled surfaces, which plates are attached to the supports or extensions of them.

In one embodiment of the invention the plates have opposed corrugated surfaces, the troughs of one surface receiving the crests of the other, and vice versa, so that when an end of a flexible strip is placed between the plates and the plates gradually tightened onto the strip, so the tension in the strip is increased. This form of fixing is of particular use with strips not easily susceptible to spot welding their ends to single plates, e.g. carbon fibre strips.

The plates are suitably joined by screws, or nuts and bolts, which simultaneously fix the plates to the respective support. The plates may, however, be of the self-locking type, for instance one edge of the plate may be plain and the parallel edge provided with a channel, the plain edge of one plate fitting lockingly in the channel of the other plate, and vice versa.

In another aspect of the invention a method of tensioning a flexible strip about a support comprises attaching an end of said strip to a fixing, attaching said fixing to said support or to an extension thereof, and tightening said fixing on said support or said extension, wherein during tightening of said fixing, movement of a part of said fixing in the tightening direction is arrested while movement of the rest of said fixing in the tightening direction continues.

The fixing may consist of a single plate to which an end of the strip is attached, e.g. by spot welding, but preferably, and especially when spot welding might not be feasible, the fixing comprises a pair of profiled plates as in the first aspect of the invention. Preferably also the support or extension is provided with a protuberance or shoulder against which part of the fixing abuts while the rest of the fixing moves in the tightening direction to tension the strip.

The accompanying drawings, which are given for the purpose of illustration only, show a number of embodiments of the present invention. In the drawings, which are schematic in nature, FIG. 1 is a plan view of two supports hingedly joined together, showing two methods of attaching the ends of the strips to the supports;

Figure 1:
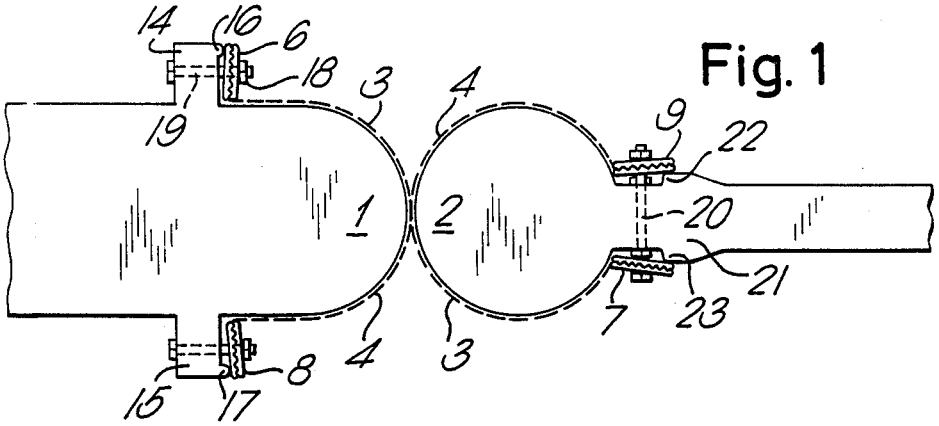
Figure 2:
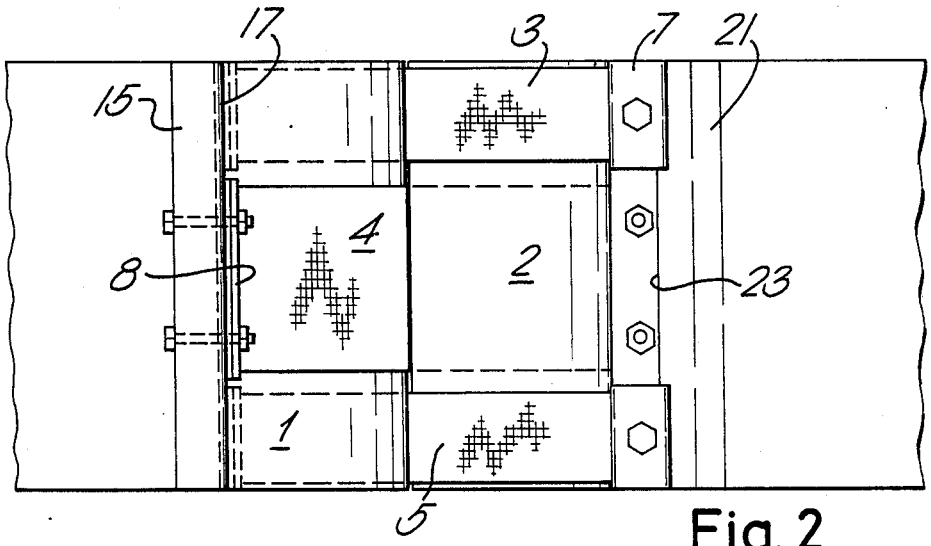
FIG. 2 is a side elevation of FIG. 1.

Referring to FIGS. 1 and 2, two parallel supports 1,2 are hinged together by means of three flexible strips 3,4 and 5 arranged in such a manner that, when viewed in plan, they form a letter "X" configuration. Thus, strip 3 passes partially around support 1 and partially around support 2. Strip 4 passes partially around the opposite side of support 1 and partially around the opposite side of support 2 from strip 3. Strip 5 is attached in like manner to strip 3. but below strip 4.

The ends of strips 3 and 5 are attached to supports 1 and 2 by means of fixings 6 and 7 respectively. The ends of strip 4 are attached to supports 1 and 2 by means of fixings 8 and 9 respectively.

Figure 5:
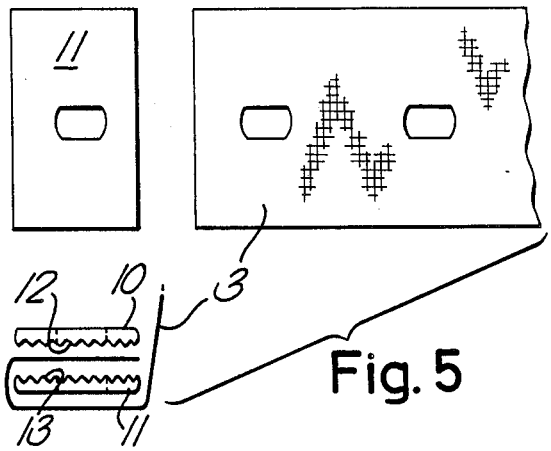
FIG. 5 is a diagram showing the method of clamping the end of a flexible strip between two profiled plates.

Fixings 6–9 are shown in more detail in FIG. 5. They are identical and each comprises two plates 10,11 having corrugated facing surfaces. The plates 10,11 are so arranged that the crests 12 of plate 10 are opposite, and therefore mate with the troughs 13 of the plate 11. FIG. 5 shows the preferred way of crimping the strip 3 between the plates 10 and 11.

Fixings 6 and 8, each comprising opposed plates 10 and 11, are attached to radial projections 14,15 respectively on support 1. The projections 14,15 are provided with protuberances 16,17 respectively against which the fixings 6 and 8 react. Thus, as the nuts 18 are tightened on the bolts 19 the strips 3 and 4 are clamped between the plates and the tension in the strips is increased.

The other ends of the strips 3–5 are attached to the support 2 by fixings 7,9, each of which is identical in form to fixings 6 and 8. The manner of attachment is slightly different, however, in that the fixings 7 and 9 are attached together by bolts 20 passing through a radial projection 21 of the support 2, this projection 21 having shoulders 22 and 23 for a purpose identical with that of protuberances 16 and 17.

Figure 3:
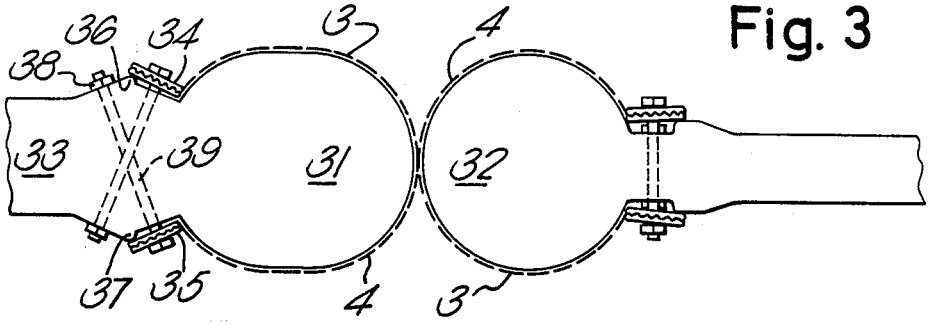
FIG. 3 is a view, similar to that of Figure, showing further means of attaching the ends of the strips to the supports.
Figure 4:
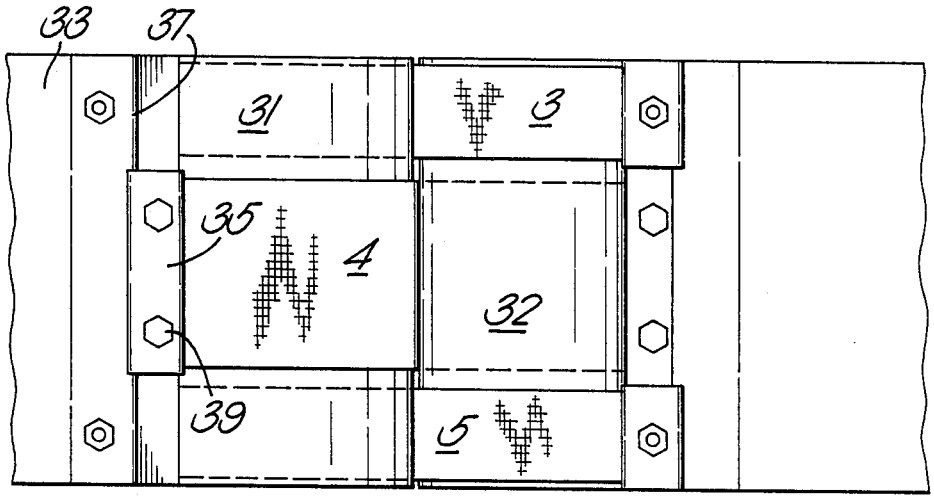
FIG. 4 is a side elevation of FIG. 3.

FIGS. 3 and 4 show a further method of attaching the ends of the strips 3–5 to supports 31 and 32 (support 32 being identical to support 2 in FIGS. 1 and 2). As will be seen, the ends of the strips 3–5 are attached to a radial extension 33 of support 31 by fixings 34,35, which are identical to fixings 6–9, the extensions 33 having shoulders 36 and 37 for use in a manner identical to that of protuberances 16 and 17. Thus, when nuts 38 are tightened onto bolts 39, the plates 10 and 11 of fixings 34 and 35 move both to clamp the ends of the strips and to increase the tension therein.

Figure 6:
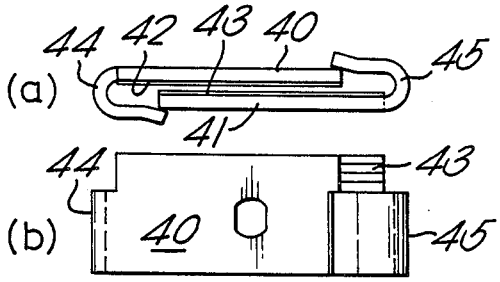
FIG. 6 is a plan view and side elevation of a pair of self-locking plates.

FIG. 6 shows an alternative form of locking plate, FIG. 6(*a*) being a plan view and FIG. 6(*b*) being a side elevation. The fixing consists of two plates 40,41, having profiled opposing surfaces 42,43 respectively. A channel section 44 is bent out of or welded onto one edge of plate 40 and a similar channel section 45 is welded to the opposite edge of plate 41. In use, once an end of a resilient strip has been inserted between the faces 42,43, the plates are closed together, the plain edge of plate 40 entering the pocket formed by channel section 45, and the plain edge of plate 41 likewise entering the pocket formed by channel section 44. The flexible strip (not shown) is thereby clamped between the plates 40 and 41. The fixing formed by the plates 40,41 may then be attached to the supports 1,2, 31,32, in the same way as the fixings 6,7 etc.

The present invention finds use in any application where it is required that two members be hingedly attached together in a frictionless or substantially frictionless manner. Thus, by way of example only, the invention may be used in the construction of display panels, as in our earlier specification; in robotics, for example for constructing robotic arms; in constructing earthmoving equipment; in constructing balances and scales; and in the aeronautics and aerospace industries.

We claim:

1. A hinged structure in which two substantially cylindrical supports are hinged together by means of at least one hinge so that they are parallel and closely adjacent, wherein each hinge comprises at least two separate members each made of resiliently flexible strip material, each member being S-shaped, passing partially around each support and crossing with one of the other members forming a letter "x" configuration as seen in a direction along the supports, the ends of each strip being crimped between and around separate plates having opposed complementarily profiled surfaces, each of said separate plates are attached to the supports whereby the strips are tensioned around the supports at opposite sides.

2. A structure as claimed in claim 1 wherein said plates have corrugated surfaces, the corrugations of one surface receiving the crests of the other, and end of said flexible strip being placed between the plates and the plates gradually tightened onto the strip.

3. A structure as claimed in claim 1 or 2 wherein the plates are joined together by means simultaneously fixing them to the respective support.

4. A structure as claimed in claim 1 or 2 wherein one edge of a plate is plain and the parallel edge is provided with a channel, the plain edge of one plate fitting lockingly in the channel of the other plate.

5. A structure according to claim 1 wherein each of said separate plates are attached to extensions of said supports.

* * * * *